US007484907B2

(12) United States Patent
Yang

(10) Patent No.: US 7,484,907 B2
(45) Date of Patent: Feb. 3, 2009

(54) SOLAR ENERGY LANE MARKING SYSTEM

(76) Inventor: Fufu Yang, 131F, Block 1, No. 2, Tian Bei Yi Road, Luohn, Shenzhen, Guangdong (CN)

( * ) Notice: Subject to any disclaimer, the term of this patent is extended or adjusted under 35 U.S.C. 154(b) by 0 days.

(21) Appl. No.: 11/378,529

(22) Filed: Mar. 17, 2006

(65) Prior Publication Data

US 2007/0217864 A1 Sep. 20, 2007

(51) Int. Cl.
*E01F 9/06* (2006.01)

(52) U.S. Cl. ..... 404/12; 404/11; 404/13; 404/14; 404/15; 404/16; 362/153.1

(58) Field of Classification Search ..... 404/11–16; 362/153.1; 340/573.2
See application file for complete search history.

(56) References Cited

U.S. PATENT DOCUMENTS 4,050,834 A * 9/1977 Lee ..... 404/16
4,200,904 A * 4/1980 Doan ..... 362/183
4,243,928 A * 1/1981 Nazimek ..... 320/101
4,653,931 A * 3/1987 Takeda ..... 368/205
4,841,278 A * 6/1989 Tezuka et al. ..... 340/908.1
4,993,868 A * 2/1991 Eigenmann ..... 404/12
5,032,961 A * 7/1991 Pouyanne et al. ..... 362/251
5,252,893 A * 10/1993 Chacham et al. ..... 315/200 A
5,680,033 A * 10/1997 Cha ..... 359/542
5,839,816 A * 11/1998 Varga et al. ..... 362/153.1
5,984,570 A * 11/1999 Parashar ..... 404/14
6,107,941 A * 8/2000 Jones ..... 340/915
6,210,017 B1 * 4/2001 Miura et al. ..... 362/153.1
6,275,127 B1 * 8/2001 French ..... 335/285
6,384,742 B1 * 5/2002 Harrison ..... 340/944
6,655,814 B1 * 12/2003 Tagawa et al. ..... 362/183
6,929,378 B2 * 8/2005 Wang ..... 362/153.1
7,113,098 B1 * 9/2006 Hayes ..... 340/573.2
7,317,405 B2 * 1/2008 Green et al. ..... 340/907
2003/0053307 A1 * 3/2003 Talamo et al. ..... 362/153.1
2003/0137831 A1 * 7/2003 Lin ..... 362/183
2005/0030739 A1 * 2/2005 Wang ..... 362/153.1
2006/0123679 A1 * 6/2006 Scruggs ..... 40/559

* cited by examiner

*Primary Examiner*—Raymond W Addie
(74) *Attorney, Agent, or Firm*—Raymond Y. Chan; David and Raymond Patent Firm

(57) ABSTRACT

A solar energy lane marking system for a road surface having at least a traffic lane includes a set of lane markers, and a solar energy collection arrangement. The lane markers are for spacedly providing on the road surface to define the traffic lane, wherein each of the lane markers includes an illuminator for lane illumination. The solar energy collection arrangement is for controlling the set of lane markers in centralized manner to ensure sufficient and consistent illumination of the illuminators, and includes a solar energy collector for collecting solar energy, an energy storage, and a central processing circuitry. The central processing circuitry, which is electrically connecting the energy storage with the illuminators of the lane markers, operatively controls the illuminators of the lane markers as an illuminable road divider for identifying the traffic lane in case of low visibility of the traffic lane.

13 Claims, 5 Drawing Sheets

SOLAR ENERGY LANE MARKING SYSTEM

BACKGROUND OF THE PRESENT INVENTION

1. Field of Invention

The present invention relates to a lane marking system, and more particularly to a solar energy lane marking system which is capable of centrally collecting solar energy for use by a predetermined section of lane markers so as to ensure sufficient and consistent illumination of the lane markers.

2. Description of Related Arts

Conventionally, lanes on a road are divided by painted lines for drivers to recognize. There are plenty disadvantages in associated with it. In many occasions, drivers are unable to see the painted lines clearly so as to cause many accidents. As a result, conventional lane markers have been developed for replacing traditional painted lines. In general, these conventional lane markers contain reflective materials which are capable of providing reflective illumination when they are exposed to the light emitted from vehicles' headlights. Therefore, these conventional lane markers merely passively illuminate in the sense that they would only provide illumination upon reflection of the light emitted by vehicles' headlights. This kind of lane markers are said to have short life-span, require frequent replacement, and therefore involve expensive maintenance costs. As an improvement of these lane markers, more sophisticated lane markers using solar energy for providing illumination have been developed. For example, China patent of 02273163 a kind of solar energy lane markers system which comprises a solar battery, a solar recharge circuitry, a conversion circuitry, a control circuitry, a solar energy collection board, and a lane marker comprising an illumination unit for providing illumination as powered by solar energy. Despite relieving some deep-seated problems for conventional lane makers, this type of solar energy lane markers system has the disadvantages that the solar energy collection board usually cannot collect sufficient amount of solar energy for use by the respective lane markers. Moreover, since the solar energy collection board is located near the lane markers, when there is no sunlight, the illumination unit would have insufficient power to operate so that the lanes cannot be clearly divided. Obviously, this can lead to disastrous consequences. Furthermore, even if the solar battery is fully charged, it can only be continuously utilized for up to around twenty hours. The disadvantages are further elaborated as follows.

Limited life-span: the solar battery usually has very limited life-span so that it must be replaced very frequently. As a matter of general estimation, the solar battery can only be recharged for about 1000 times. Moreover, since the solar battery is typically installed on the road, therefore, its size cannot be too bulky. This further limits the ability of the solar battery providing adequate power to the illumination unit.

Frequent mechanical disorder: as a matter of fact, the solar energy lane marking system is to be used in a heavily-polluted and adverse environment. For example, the lane makers are expected to be occasionally hit by vehicles' tires. Consequently, the mechanical and electrical components are easily damaged in such adverse environment so as to induce expensive maintenance cost of conventional solar energy lane makers system.

Inflexible operation: conventional lane makers usually adopt one of the following modes of operation, they either illuminate continuously or flashing in a predetermined manner. As a result, they lack flexibility in that these two modes of operations may not be suitable in all environments, such as when the weather under which the lane marking system is utilized is dull or when the lane marking system is utilized on rural areas or uphill road. In such situations, the lane markers must be kept illuminating even during daytime.

SUMMARY OF THE PRESENT INVENTION

A main object of the present invention is to provide a solar energy lane marking system which is capable of centrally collecting solar energy for use by a predetermined section of lane markers so as to ensure sufficient and consistent illumination of the lane markers. In other words, the present invention substantially overcomes the disadvantages in the above-mentioned conventional arts.

Another object of the present invention is to provide a solar energy lane marking system which comprises a solar energy collector which is spacedly apart from the lane markers, so as to facilitate convenient maintenance and minimize the possibility that the solar energy collector is damaged by adverse environmental conditions.

Another object of the present invention is to provide a solar energy lane marking system which comprises a control circuitry capable of controlling an operation of a plurality of illuminating units in a continuous manner so as to flexibly control an operation of the lane marking system according to different circumstances.

Another object of the present invention is to provide a solar energy lane marking system which is durable and adapted for use in a wide variety of environments so as to promote widespread application of the present invention.

Accordingly, in order to accomplish the above objects, the present invention provides a solar energy lane marking system for a road surface having at least a traffic lane, comprising:

at least a set of lane markers for spacedly providing on the road surface to define the traffic lane, wherein each of the lane markers comprises an illuminator for lane illumination; and at least a solar energy collection arrangement for controlling the set of lane markers in centralized manner to ensure sufficient and consistent illumination of the illuminators, which comprises:

a solar energy collector, which is arranged for positioning away from the traffic lane, comprising a solar energy collecting board for collecting solar energy and a solar energy conversion circuitry for converting the solar energy collected from the solar energy collecting board into an electrical energy;

an energy storage electrically connecting to the solar energy collector for storing the electrical energy; and a control circuitry, which is electrically connecting the energy storage with the illuminators of the lane markers, wherein the control circuitry operatively controls the illuminators of the lane markers as an illuminable road divider for identifying the traffic lane in case of low visibility of the traffic lane.

These and other objectives, features, and advantages of the present invention will become apparent from the following detailed description, the accompanying drawings, and the appended claims.

DETAILED DESCRIPTION OF THE PREFERRED EMBODIMENT

Figure 1:
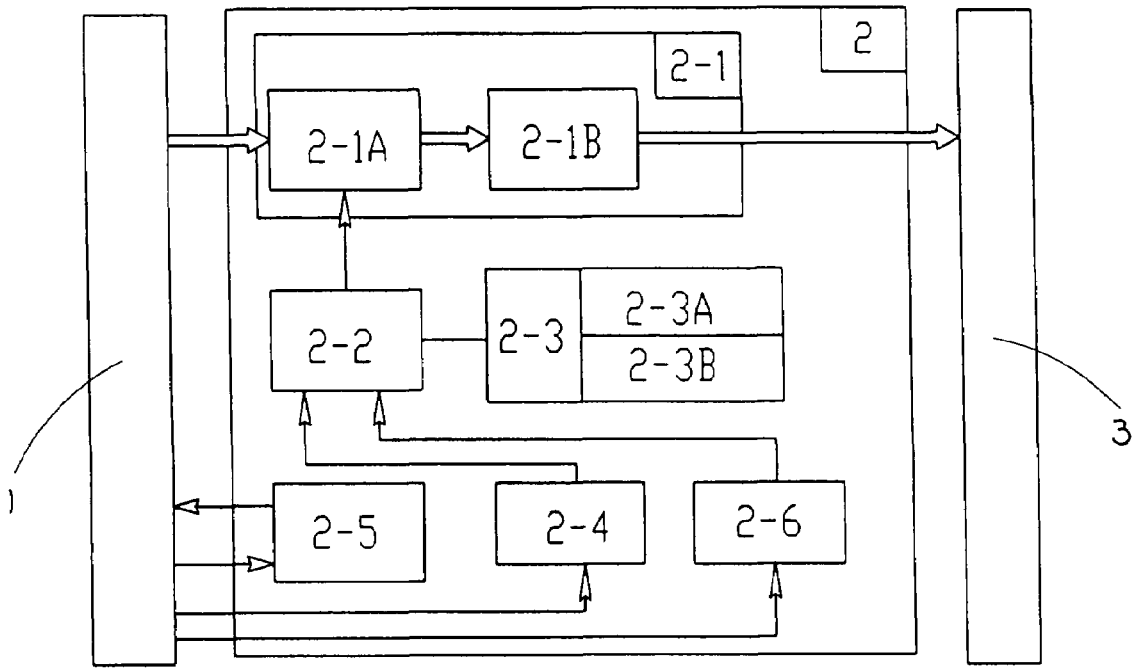
FIG. 1 is a schematic diagram of a solar energy lane marking system according to a preferred embodiment of the present invention.

Referring to FIG. 1 to FIG. 5 of the drawings, a solar energy lane marking system for a road surface having at least a traffic lane according to a preferred embodiment of the present invention is illustrated, in which the solar energy lane marking system comprises at least one set of lane markers, and at least a solar energy collection arrangement.

The set of lane markers 10 is for spacedly providing on the road surface 70 to define the traffic lane, wherein each of the lane markers 10 comprises an illuminator 3 used for lane illumination.

The solar energy collection arrangement is for controlling the set of lane markers 10 in centralized manner so as to ensure sufficient and consistent illumination of the illuminators 3. The solar energy collection arrangement comprises a solar energy collector, an energy storage, and a central processing circuitry 2.

The solar energy collector, which is arranged for positioning away from the traffic lane, comprises a solar energy collecting board 4 for collecting solar energy and a solar energy conversion circuitry 1 for converting the solar energy collected from the solar energy collecting board 4 into electrical energy. The energy storage is electrically connected to the solar energy collector for storing the electrical energy.

The central processing circuitry 2 is electrically connecting the energy storage with the illuminators 3 of the lane markers 10, wherein the central processing circuitry 2 operatively controls the illuminators 3 of the lane markers 10 as an illuminable road divider for identifying the traffic lane in case of low visibility thereof.

According to the preferred embodiment of the present invention, the solar energy collection arrangement further comprises a signal adjustment circuitry 31 electrically connecting between the central processing circuitry 2 and the energy storage for adjusting an electrical signal and optimally delivering the electric signal to the energy storage for recharging thereof. The signal adjustment circuitry 31 is controlled by the central processing circuitry 2 in order to coordinate the entire solar energy collection and recharging process by the solar energy collection arrangement.

More specifically, the signal adjustment circuitry 31 is adapted to perform signal resonant in such a manner that it is capable of delivering an output signal having a predetermined wave form and a set of parameters for optimal use by the illuminators 3.

The present invention is operated in response to weather conditions. As such, the central processing circuitry 2 comprises an energy supplying circuitry 2-1, a control circuitry 2-2, a weather sensing circuitry 2-3, a timer circuitry 2-4, and a recharge control circuitry.

Figure 3:
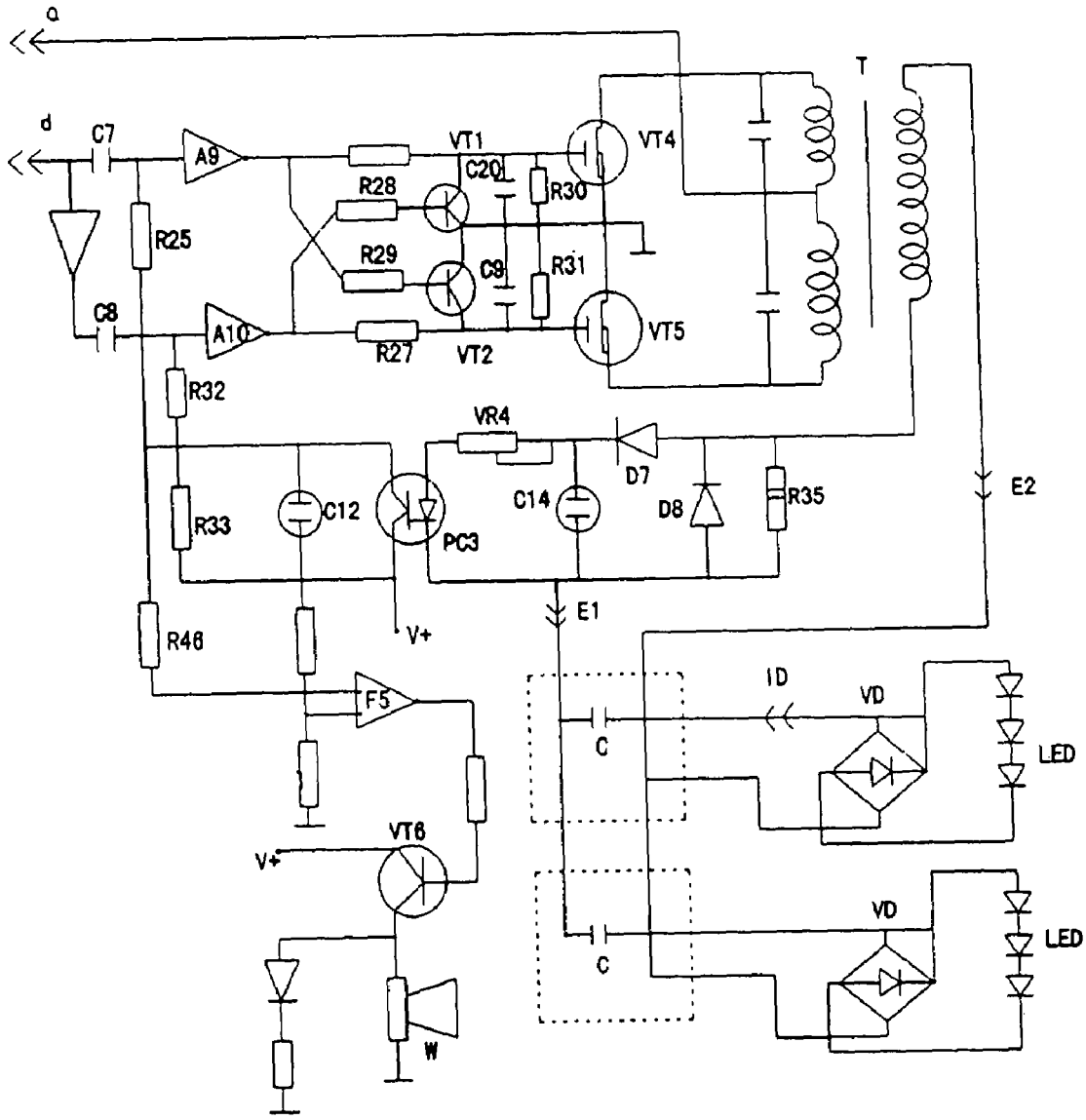
FIG. 3 is a circuit diagram of the solar energy conversion circuitry according to the above preferred embodiment of the present invention.
Figure 4:
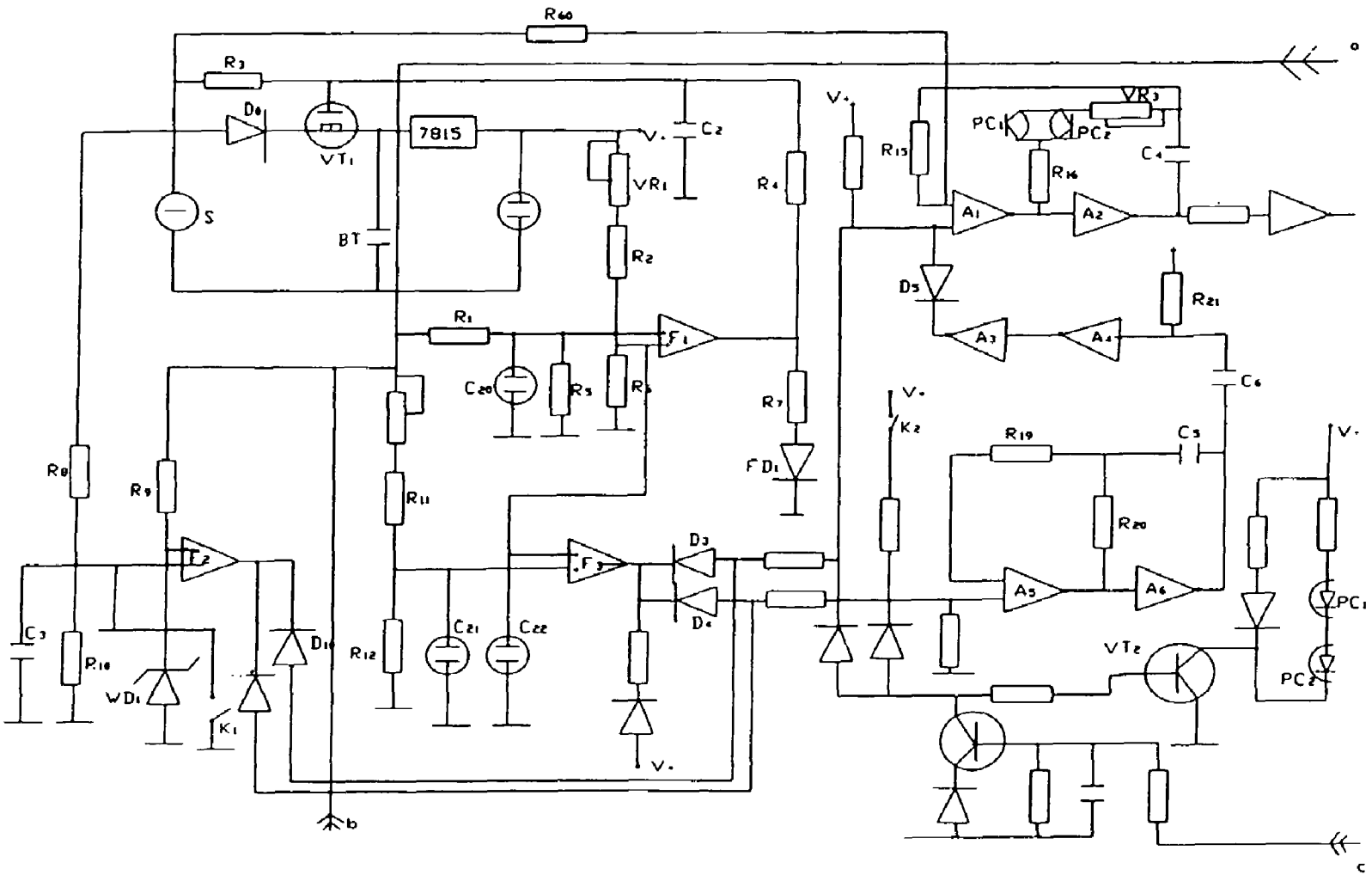
FIG. 4 is a circuit diagram of the solar energy collection arrangement according to the above preferred embodiment of the present invention.
Figure 5:
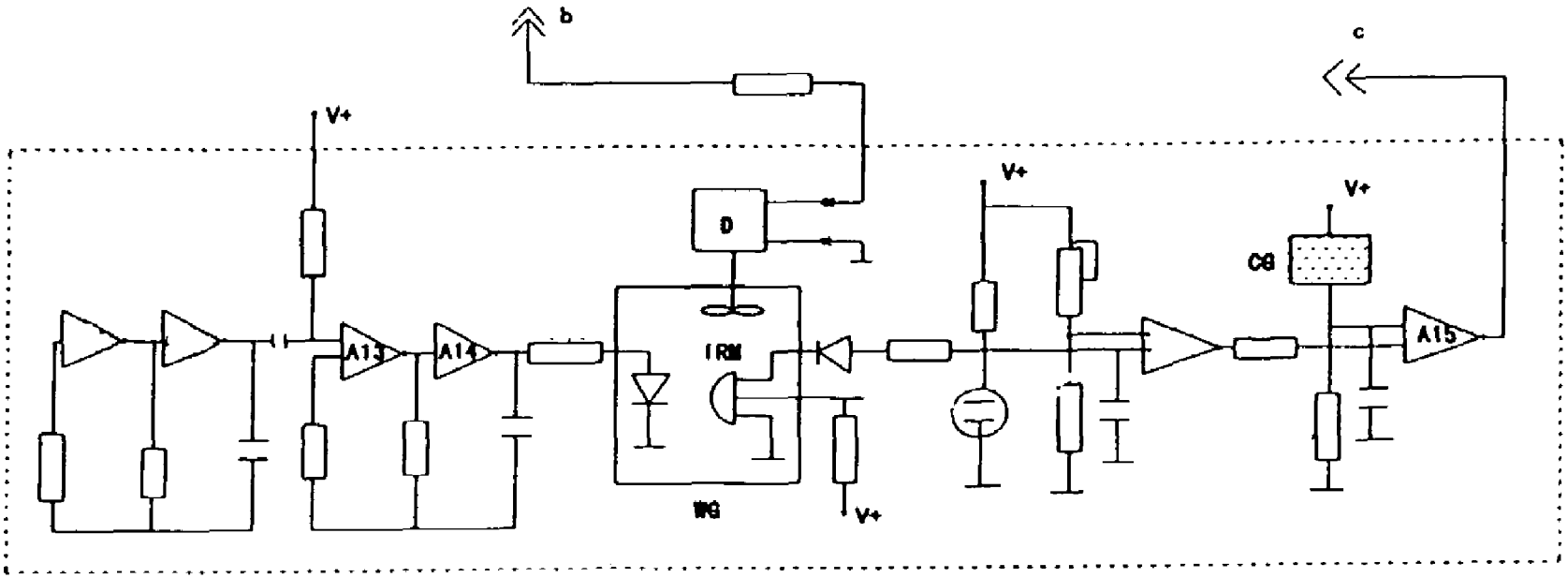
FIG. 5 is a schematic diagram of the solar energy collection arrangement according to the above preferred embodiment of the present invention.

Referring to FIG. 3 to FIG. 5 of the drawings, the energy storage is preferably embodied as a rechargeable battery (BT) which is electrically connected with the solar energy conversion circuitry 1 via a Schootky diode (D0) and control MOSFET (VT1), in such a manner that when the energy collecting board 4 is operated during daytime, the solar energy conversion circuitry 1 is adapted to convert the solar energy collected into electrical energy and store in the rechargeable battery (BT) as controlled by the control circuitry 2-2.

The recharge control circuitry comprises an overcharge prevention circuitry 2-5 electrically connected with the energy conversion circuitry 1 to prevent the energy storage for being overcharged. In particular, the overcharge prevention circuitry 2-5 comprises a plurality of resistors ($R_1$, $R_2$, $R_3$, $R_4$, $R_5$, $R_6$, $VR_1$), a plurality of capacitors ($C_2$, $C_{20}$) and a comparative amplifier ($F_1$) electrically connected in a predetermined manner, wherein the overcharge prevention circuitry 2-5 is adapted to continually supplying electric signal for recharging the rechargeable battery (BT) when its capacity has not reached a predetermined maximum level, and to stop feeding electric signal to the rechargeable battery (BT) when it is fully charged. In order to indicate that the rechargeable battery (BT) is being recharged, the rechargeable control circuitry further comprises a recharge indicating circuitry which comprises a resistor ($R_7$) and a LED ($VD_1$) electrically connected with the overcharge prevention circuitry 2-5 in such a manner that when the rechargeable battery (BT) is being recharged, the LED is lit up for indicating that the recharge process is being carried out.

Moreover, the recharge control circuitry further comprises an energy preventative-lost circuitry 2-6 which comprises a comparative amplifier ($F_3$), a variable resistor ($VR_1$), a plurality of fixed resistors ($R_{11}$, $R_{12}$), a plurality of capacitors ($C_{21}$, $C_{22}$), and a plurality of diodes ($D_3$, $D_4$) electrically connected in a predetermined manner for stopping the rechargeable battery (BT) from discharging electricity which has been stored therein when the rechargeable battery (BT) is not being recharged so as to maintain a predetermined minimum level of energy retaining in the rechargeable battery (BT).

On the other hand, the timer circuitry 2-4 comprises a comparative amplifier $F_2$, a plurality of resistors ($R_8$, $R_9$, $R_{10}$), a capacitor $C_3$, a clamping diode $WD_1$, a diode $D_{10}$, and a comparative switch $K_1$ electrically connected in a such a manner that when the comparative switch $K_1$ is in 'off' state, the signal adjustment circuitry 31 is deactivated so that the illuminators 3 of the lane markers 10 is as well deactivated. It is worth mentioning that when the comparative switch $K_1$ is in the off state, and when the energy collection arrangement is operating during daytime, the rechargeable battery (BT) is arranged to discharge a predetermined higher level of electrical signal which is to be fed into the comparative amplifier $F_2$ at an inverting terminal thereof, so that the comparative amplifier $F_2$ outputs a low level electrical signal to the signal adjustment circuitry 31 for keeping it inactive so as to keep the illuminators 3 inactive. However, when the solar energy collector is operating in an environment where there is inadequate sunlight, such as during nighttime, the rechargeable battery (BT) is arranged to discharge a predetermined lower level of electrical signal to the inverting terminal of the comparative amplifier $F_2$ so as to invoke it to generate a high output for activating the signal adjustment circuitry 31 which then activates the relevant illuminators 3 to provide illumination at the respective lane markers 10.

In contrast, when the comparative switch $K_1$ is in 'on' state, the comparative amplifier $F_2$ is arranged to output a high level of electrical signal so as to continually activate the signal adjustment circuitry 31 for continuously activating the illuminators to provide consistent and effective illumination of the relevant lane markers 10.

The weather sensing circuitry 2-3 comprises a light sensing circuitry 2-3A and a smog sensing circuitry 2-3B electrically connected with each other for sensing a weather condition of the environment in which the present invention is operating. The smog sensing circuitry 2-3B comprises a moisture sensor CG and a NAND gate ($A_{15}$), wherein the smog sensing circuitry 2-3B is adapted to detect a moisture change of the environment in which the present invention is operating.

On the other hand, the light sensing circuitry 2-3A comprises a plurality of NAND gates ($A_{13}$, $A_{14}$), an infrared sensor (IRM) and a LED electrically connected in a predetermined manner for detecting a light intensity of the environment in which the present invention is operating. In particular, the light sensing circuitry 2-3A responses to light intensity change when the infrared sensor (IDM) sensing ambient light of varying intensity.

The control circuitry 2-2 comprises a control switch ($K_2$), a plurality of NAND gates ($A_5$, $A_6$) electrically connected in a predetermined manner to form a low-frequency resonant circuit. In particular, the control circuitry 2-2 is electrically connected with the timer circuitry 2-4 in such a manner that the timer circuitry 2-4 is adapted to cooperately working with the control circuitry 2-2.

The control MOSFET ($VT_1$) of the solar energy conversion circuitry I is electrically connected with the overcharge prevention circuitry 2-5 which is electrically connecting with the rechargeable battery (BT) so as to electrically connecting the solar energy conversion circuitry 1 with the rechargeable battery (BT) for recharging and the rechargeable battery (BT) in the above-described controlled manner, i.e. the possibility of overcharging or discharging of electricity is minimized.

Figure 2:
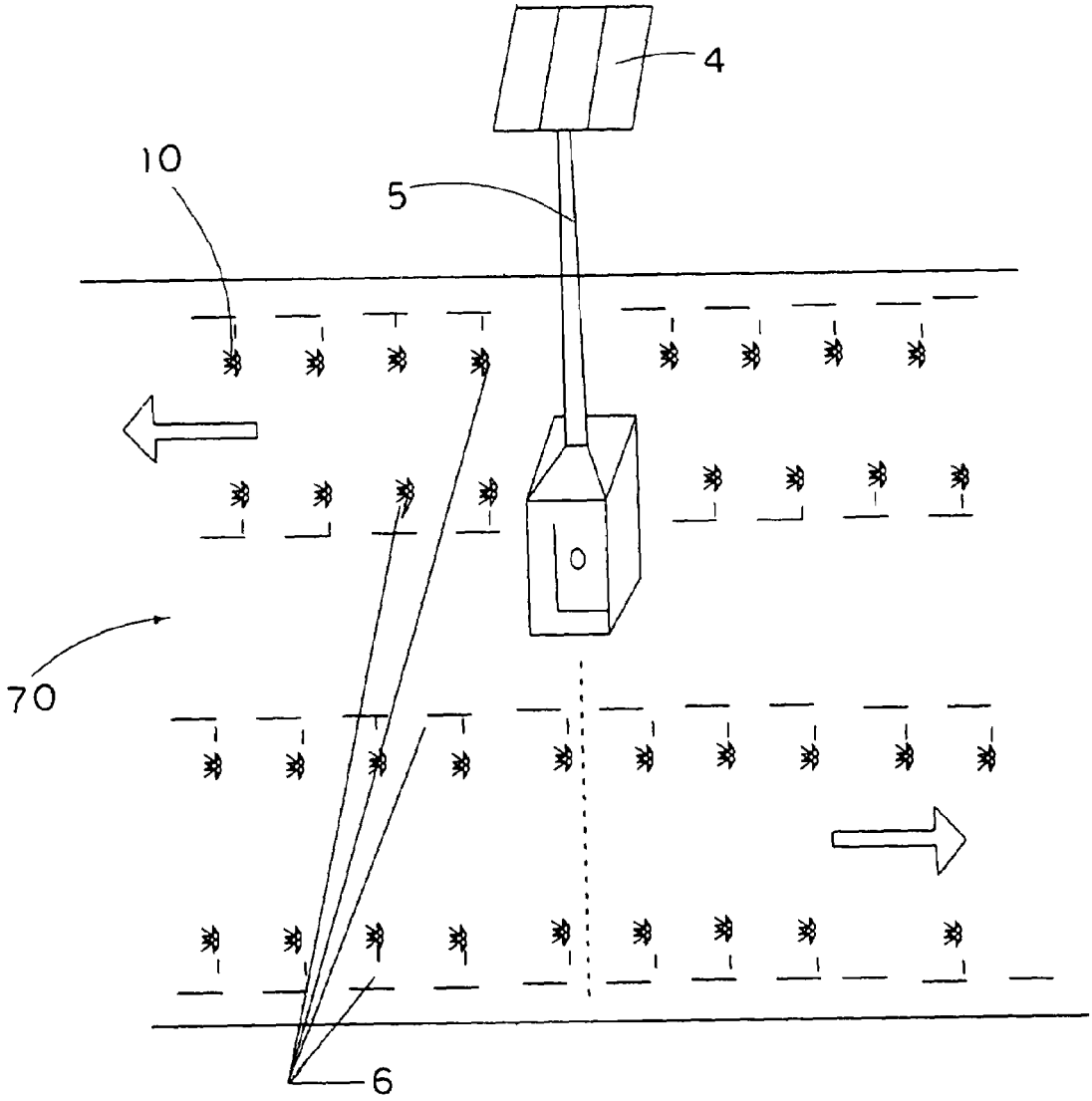
FIG. 2 is a schematic diagram of the solar energy lane marking system according to the above preferred embodiment of the present invention, illustrating how the solar energy lane marking system is implemented in a typical road.

Referring to FIG. 2 of the drawings, the solar energy collection board 4 is preferably placed in a solar energy housing 6 which is installed apart (preferably 1000 m apart) from the lane markers 10 for centrally collecting solar energy for supplying energy to a predetermined number of lane markers 10. As shown in the drawings, the solar energy housing 6 may be elevated by a supporting member 5 upwardly extended from the ground surface on which the energy housing 6 is supported.

Referring to FIG. 3 of the drawings, $A_5$, $A_6$, $R_{19}$, $R_{20}$, $C_5$ constitute a low frequency vibrating circuit having a period of 0.8 to 1 second, wherein when A5 receives an input that the weather is smoggy or when $K_2$ is in off state, the vibrating circuit states to initiate a vibrating cycle, which generate a square-shape output signal. $R_{21}$ and $C_6$ would then adjust the wavelength of the output signal to a duty cycle of around 0.15.

However, when there is no smog or when $K_2$ is in off state, the vibrating circuit stops generating vibration so that there is no output signal at $A_6$ while $A_4$ maintains at high level, the signal is then inverted at $A_3$ and $A_4$.

On the other hand, $A_1$, $A_2$, $R_{15}$, $R_{16}$, $PC_1$, $VR_3$, $C_4$ constitute a low-frequency vibrating circuit having a frequency of around 0.8 KHz to 1.6 KHz, wherein $VR_3$, $PC_1$ and $PC_2$ are manually or automatically variable. When $D_5$, $D_3$ and $D_{10}$ have been cut off, $A_2$ will output a rectangular impulse which is arranged to be inverted by $A_7$ and $A_8$. The inverted impulse will then be adjusted by $C_7$, $C_8$, $R_{25}$, $R_{32}$, $R_{33}$, $C_{12}$, $PC_2$. In normal circumstances, $A_9$ and $A_{10}$ will output rectangular signal which has a duty cycle of around 0.4. This output signal will then fed into $R_{28}$, $R_{27}$, $R_{30}$ and $R_{31}$ and $VT_4$, $VT_5$ for forming an alternate signal at transformer T, wherein $R_{28}$, $R_{29}$, $VT_1$ and $VT_2$ constitute a self-protective circuitry, and $C_{20}$ and $C_9$ are interference blocking capacitors.

$R_{60}$ is electrically connected with a positive terminal of the rechargeable battery (BT) and $A_1$, for adjusting an intensity of the illuminators 4 in response to an intensity of ambient light intensity. For the capacitor C, $[I_0=2\pi FC(V_0-V_1)]$, wherein $V_1=VD+V_{LED}\times 3$.

Referring to FIG. 3 of the drawings, $R_{33}$, $C_{12}$, $PC_3$, $C_{14}$, $VR_4$, $D_7$, $D_8$, $R_{35}$ constitute a voltage limitation circuitry, wherein when the loading to this circuitry increases, current may pass through $PC_3$, the input terminal of $A_9A_{10}$ increases, the corresponding duty cycle decreases, and current is substantially limited.

When current increases, the electric level of B becomes very small, the signal will pass through $R_{46}$ and $F_5$ which will have a very high output, current may pass through $TV_6$, $FD_{13}$ will then illuminate and W sounds.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims What is clamed is:

1. A solar energy lane marking system for a vehicular road surface having at least a traffic lane, comprising:

at least a set of lane markers spacedly provided on said road surface to define said traffic lane, wherein each of said lane markers comprises an illuminator adapted to automatically and continuously generate illumination for said traffic lane; and at least a solar energy collection arrangement positioned substantially away from said traffic lane to be set up in an sunny environment so as to ensure that said solar energy collection arrangement has continuous supply of solar energy irrespective of weather condition of where said lane markers are located, and is protected from accidental damage by vehicles traveling along and across said traffic lane, wherein said solar energy collection arrangement comprises:

a solar energy collector comprising a solar energy collecting board adapted for collecting solar energy, and a solar energy conversion circuitry adapted for converting said solar energy collected from said solar energy collecting into electrical energy, wherein said solar energy collector is installed at a position which is spaced apart from said traffic lane for avoiding accidental damage of said solar energy collector by vehicles, and has a sufficient supply of sunlight;

an energy storage comprising a rechargeable battery electrically connecting to said solar energy collector for storing said electrical energy in a centralized manner for said lane markers; and a central processing circuitry electrically connecting said energy storage with said illuminators of said lane markers, wherein said central processing circuitry centrally controls said illuminators of said lane markers as an illuminating road divider for identifying at least one road segment of said traffic lane, in such a manner that said solar energy collection arrangement is adapted to provide uninterrupted supply of solar energy to said lane markers on said road segment irrespective of weather condition under which said lane markers operate, wherein said central processing circuitry comprises a recharge control circuitry comprising an overcharge prevention circuitry electrically connected with said energy conversion circuitry to prevent said energy storage for being overcharged, and an energy preventative-lost circuitry which comprises a comparative amplifier ($F_3$), a variable resistor ($VR_1$), a plurality of fixed resistors ($R_{11}$, $R_{12}$), a plurality of capacitors ($C_{21}$, $C_{22}$), and a plurality of diodes ($D_3$, $D_4$) electrically connected in a predetermined manner for stopping said rechargeable battery from discharging electricity which is stored therein when said rechargeable battery is idle so as to maintain a predetermined minimum level of energy in said rechargeable battery.

2. The solar energy lane marking system, as recited in claim 1, wherein said solar energy collection arrangement further comprises a signal adjustment circuitry electrically connecting between said central processing circuitry and said energy storage in said centralized manner for optimally adjusting and delivering an electrical signal to said energy storage for recharging thereof, wherein said signal adjustment circuitry is controlled by said central processing circuitry in order to coordinate collection of said solar energy stored in said energy storage at a distance from said lane markers.

3. The solar energy lane marking system, as recited in claim 1, wherein said rechargeable battery of said energy storage is electrically connected with said solar energy conversion circuitry via a Schootky diode ($D_0$) and control MOSFET ($VT_1$) and at a position distant away from said lane markers, in such a manner that when said energy collecting board is operated during daytime, said solar energy conversion circuitry is adapted to convert said solar energy into electrical energy and store in said rechargeable battery for use by said lane markers in said centralized manner.

4. The solar energy lane marking system, as recited in claim 2, wherein said rechargeable battery of said energy storage is electrically connected with said solar energy conversion circuitry via a Schootky diode ($D_0$) and control MOSFET ($VT_1$) and at a position distant away from said lane markers, in such a manner that when said energy collecting board is operated during daytime, said solar energy conversion circuitry is adapted to convert said solar energy into electrical energy and store in said rechargeable battery for use by said lane markers in said centralized manner.

5. The solar energy lane marking system, as recited in claim 1, wherein said central processing circuitry further comprises a timer circuitry comprising a comparative amplifier ($F_2$), a plurality of resistors ($R_8$, $R_9$, $R_{10}$), a capacitor $C_3$, a clamping diode $WD_1$, a diode $D_{10}$, and a comparative switch $K_1$ electrically connected in a such a manner that when said comparative switch ($K_1$) is in 'off' state, said signal adjustment circuitry is deactivated so that said illuminators are deactivated, and when said solar energy collector is operating in an environment where there is inadequate sunlight, said rechargeable battery is arranged to discharge a predetermined lower level of electrical signal to an inverting terminal of said comparative amplifier ($F_2$) so as to invoke said comparative amplifier ($F_2$) to generate a high output for activating said signal adjustment circuitry which then activates said illuminators to provide illumination.

6. The solar energy lane marking system, as recited in claim 3, wherein said central processing circuitry further comprises a timer circuitry comprising a comparative amplifier ($F_2$), a plurality of resistors ($R_8$, $R_9$, $R_{10}$), a capacitor $C_3$, a clamping diode $WD_1$, a diode $D_{10}$, and a comparative switch $K_1$ electrically connected in a such a manner that when said comparative switch ($K_1$) is in 'off' state, said signal adjustment circuitry is deactivated so that said illuminators are deactivated, and when said solar energy collector is operating in an environment where there is inadequate sunlight, said rechargeable battery is arranged to discharge a predetermined lower level of electrical signal to an inverting terminal of said comparative amplifier ($F_2$) so as to invoke said comparative amplifier ($F_2$) to generate a high output for activating said signal adjustment circuitry which then activates said illuminators to provide illumination.

7. The solar energy lane marking system, as recited in claim 4, wherein said central processing circuitry further comprises a timer circuitry comprising a comparative amplifier ($F_2$), a plurality of resistors ($R_8$, $R_9$, $R_{10}$), a capacitor $C_3$, a clamping diode $WD_1$, a diode $D_{10}$, and a comparative switch $K_1$ electrically connected in a such a manner that when said comparative switch ($K_1$) is in 'off' state, said signal adjustment circuitry is deactivated so that said illuminators are deactivated, and when said solar energy collector is operating in an environment where there is inadequate sunlight, said rechargeable battery is arranged to discharge a predetermined lower level of electrical signal to an inverting terminal of said comparative amplifier ($F_2$) so as to invoke said comparative amplifier ($F_2$) to generate a high output for activating said signal adjustment circuitry which then activates said illuminators to provide illumination.

8. The solar energy lane marking system, as recited in claim 5, wherein said central processing circuitry further comprises a weather sensing circuitry comprising a light sensing circuitry and a smog sensing circuitry electrically connected with each other for sensing a weather condition of said environment in which said lane marking system is operating, in such a manner that when said weather condition is bad, said central processing circuitry is adapted to drive said illuminators to continuously generate enhanced illumination by acquiring solar electricity in a different geographical location distant from said lane markers.

9. The solar energy lane marking system, as recited in claim 6, wherein said central processing circuitry further comprises a weather sensing circuitry comprising a light sensing circuitry and a smog sensing circuitry electrically connected with each other for sensing a weather condition of said environment in which said lane marking system is operating, in such a manner that when said weather condition is bad, said central processing circuitry is adapted to drive said illuminators to continuously generate enhanced illumination by acquiring solar electricity in a different geographical location distant from said lane markers.

10. The solar energy lane marking system, as recited in claim 7, wherein said central processing circuitry further comprises a weather sensing circuitry comprising a light sensing circuitry and a smog sensing circuitry electrically connected with each other for sensing a weather condition of said environment in which said lane marking system is operating, in such a manner that when said weather condition is bad, said central processing circuitry is adapted to drive said illuminators to continuously generate enhanced illumination by acquiring solar electricity in a different geographical location distant from said lane markers.

11. The solar energy lane marking system, as recited in claim 8, wherein further comprising a solar energy housing positioned away from said lane markers to such an extent that adequate solar energy collection is ensured, and a supporting member elevating said solar energy housing at a predetermined height, wherein said solar energy collector is provided on said solar energy housing for centrally collecting said solar energy for use by said lane markers.

12. The solar energy lane marking system, as recited in claim 9, wherein further comprising a solar energy housing positioned away from said lane markers to such an extent that adequate solar energy collection is ensured, and a supporting member elevating said solar energy housing at a predetermined height, wherein said solar energy collector is provided on said solar energy housing for centrally collecting said solar energy for use by said lane markers.

13. The solar energy lane marking system, as recited in claim 10, wherein further comprising a solar energy housing positioned away from said lane markers to such an extent that adequate solar energy collection is ensured, and a supporting member elevating said solar energy housing at a predetermined height, wherein said solar energy collector is provided on said solar energy housing for centrally collecting said solar energy for use by said lane markers.

* * * * *